US008936305B1

(12) United States Patent
Skursky

(10) Patent No.: US 8,936,305 B1
(45) Date of Patent: Jan. 20, 2015

(54) FOLDABLE CHAIR WITH PIVOTABLE HEADREST

(71) Applicant: Elizabeth A. Skursky, St. Petersburg, FL (US)

(72) Inventor: Elizabeth A. Skursky, St. Petersburg, FL (US)

( * ) Notice: Subject to any disclaimer, the term of this patent is extended or adjusted under 35 U.S.C. 154(b) by 0 days.

(21) Appl. No.: 14/274,862

(22) Filed: May 12, 2014

Related U.S. Application Data

(63) Continuation of application No. 14/061,639, filed on Oct. 23, 2013.

(60) Provisional application No. 61/827,425, filed on May 24, 2013, provisional application No. 61/827,426, filed on May 24, 2013.

(51) Int. Cl.
*A47C 4/00* (2006.01)
*A47C 7/38* (2006.01)
*A47C 1/024* (2006.01)

(52) U.S. Cl.
CPC ..... *A47C 7/383* (2013.01); *A47C 1/024* (2013.01)
USPC ..... 297/16.1; 297/397

(58) Field of Classification Search
CPC ..... A47C 1/143; A47C 20/026; A47C 7/38; A47C 7/36; A47C 7/383; A47C 7/072; A47C 17/66; A61G 13/121; A61G 7/072; A61G 15/125; A61H 2201/1604
USPC ..... 297/397, 392, 16.1
See application file for complete search history.

(56) References Cited

U.S. PATENT DOCUMENTS

| | | | | |
|---|---|---|---|---|
| 4,746,167 | A * | 5/1988 | Palmer et al. | 297/423.12 |
| 6,059,365 | A * | 5/2000 | Diamond | 297/354.13 |
| 6,397,414 | B1 * | 6/2002 | Lloyd | 5/622 |
| 8,272,089 | B1 * | 9/2012 | Stokes | 5/620 |
| 8,668,268 | B1 * | 3/2014 | Cormack | 297/354.13 |

* cited by examiner

*Primary Examiner* — Sarah B McPartlin
(74) *Attorney, Agent, or Firm* — Allen, Dyer, Doppelt, Milbrath & Gilchrist

(57) ABSTRACT

A lounge chair comprises a chair frame and a headrest. The chair frame includes a first seat section extending between a first section first end and a first section second end, a second seat section extending between a second section first end and a second section second end, the second section first end being pivotably connected to the first section second end such that the first and second seat sections are movable into a coplanar configuration, and a plurality of legs supporting the chair frame to elevate the first and second seat sections above an underlying surface. The headrest includes a headrest frame support extending from the first section first end, a headrest frame carried by the headrest frame support, and one or more headrest cushion sections releasably secured to the headrest frame.

14 Claims, 5 Drawing Sheets

FOLDABLE CHAIR WITH PIVOTABLE HEADREST

CROSS-REFERENCE TO RELATED APPLICATION

This application is a Continuation of U.S. patent application Ser. No. 14/061,639 filed on Oct. 23, 2013, which claims the benefit of U.S. Provisional Patent Application No. 61/827,425 filed on May 24, 2013 and U.S. Provisional Patent Application No. 61/827,426 filed on May 24, 2013 the contents of which applications are herein incorporated by reference in their entirety.

FIELD OF THE INVENTION

The present invention relates generally to lounge chairs, and, more particularly, to lounge chairs with headrest.

BACKGROUND OF THE INVENTION

Currently, if a user wants to lay face down on a lounge chair they need to turn their head. Many people have medical conditions, such as cervical spine injuries, that prevent them from assuming that position. For those people, and for people who just want to lie without turning their head, currently, they have to look through a hole in the material of the back of the chair. This position confines the body, especially the arms, shoulders and head. The location of the hole for the face limits the location of the rest of the body, limits the support provided to the head and neck/cervical area, and does not allow support of the cervical spine with neck flexion and extension.

As can be seen, there is a need for a lounge chair that is secure without limiting the movement of the body, that does not require the neck of the user to be turned to the side while lying face down, that comfortably removes and/or reduces strain on the cervical spine while lying face down or face up, that provides support of the head and neck during flexion and extension, and accommodates various horizontal positions of the head for comfort or user.

SUMMARY OF THE INVENTION

In view of the foregoing, it is an object of the present invention to provide an improved lounge chair. According to an embodiment of the present invention, a lounge chair comprises a chair frame and a headrest. The chair frame includes a first seat section extending between a first section first end and a first section second end, a second seat section extending between a second section first end and a second section second end, the second section first end being pivotably connected to the first section second end such that the first and second seat sections are movable into a coplanar configuration, and a plurality of legs supporting the chair frame to elevate the first and second seat sections above an underlying surface. The headrest includes a headrest frame support extending from the first section first end, a headrest frame carried by the headrest frame support, and one or more headrest cushion sections releasably secured to the headrest frame.

According to a method aspect, a method for reducing cervical spine strain for a prone lounge chair user includes arranging a headrest in front of an end of the lounge chair, the headrest defining a central opening and including at least one headrest cushion section, and arranging the prone lounge chair user on the lounge chair such that a head of the prone lounge chair user is supported by the at least one headrest cushion section with the head facing through the central opening.

These and other features, aspects and advantages of the present invention will become better understood with reference to the following drawings, description and claims.

DETAILED DESCRIPTION OF THE INVENTION

Figure 1:
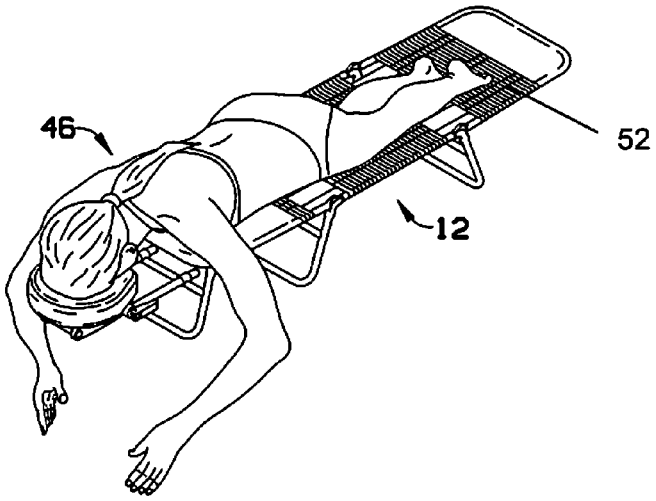
FIG. 1 is a perspective view of an exemplary embodiment of the present invention in use.
Figure 2:
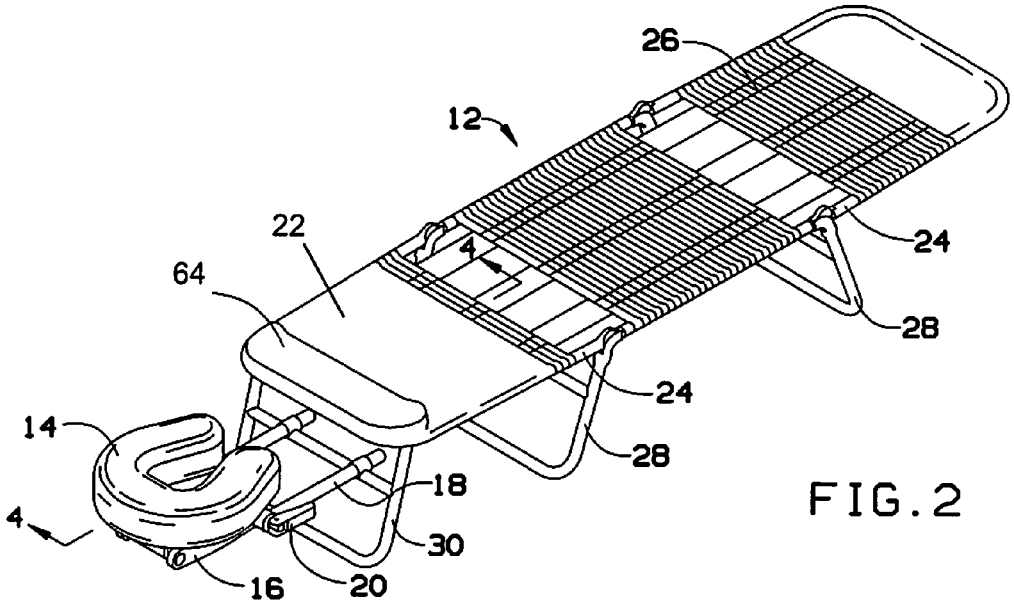
FIG. 2 is a perspective view of an exemplary embodiment of the present invention.
Figure 3:
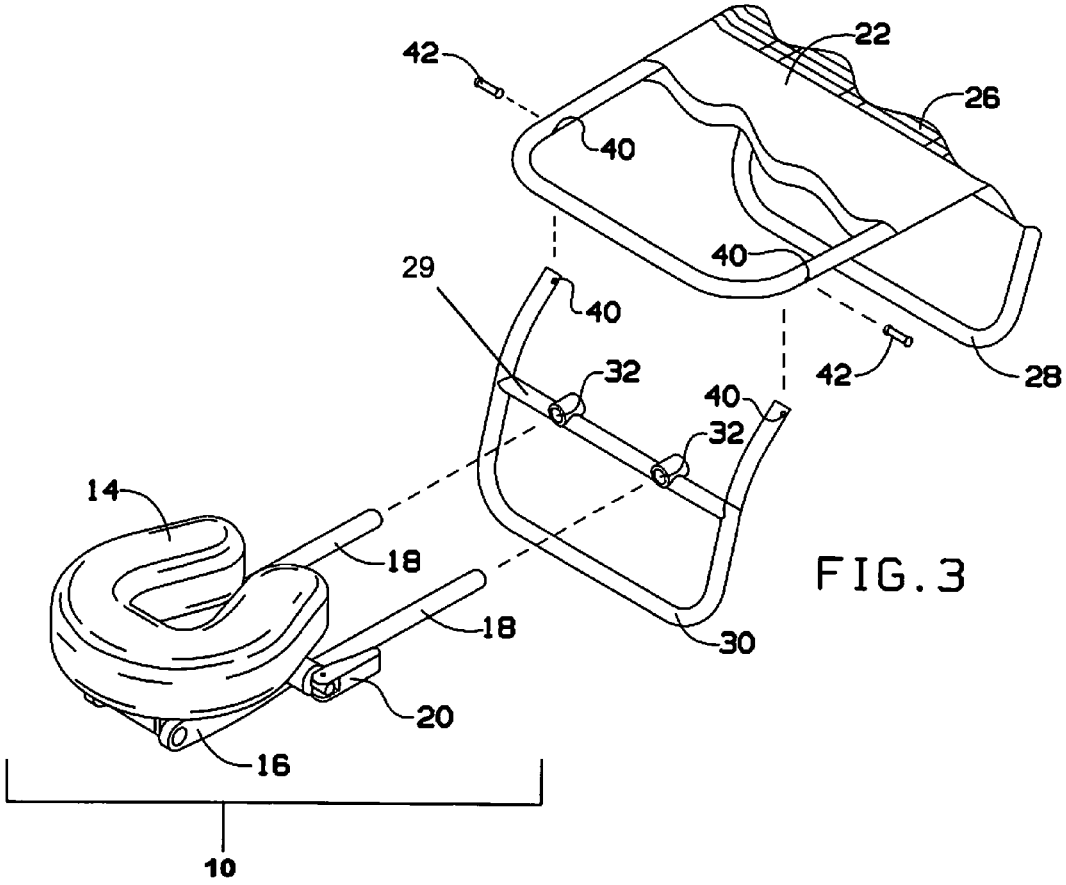
FIG. 3 is a detailed exploded view of an exemplary embodiment of the present invention with a pad and covering removed for clarity.

As The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a lounge chair with a headrest. The lounge chair with headset may include a chair frame that may include a head section and a bottom section. A plurality of legs may be attached to the chair frame. A headrest frame may include at least one headrest frame support that may be removably connected to at least one attachment connection attached to the head section of the chair frame. A headrest cushion may be connected to the headrest frame. The headrest cushion may be separated into an upper section and two lower sections. A support leg may also be attached to the chair frame, in which case, the headrest frame support may be removably connected to a bar attached to the support leg. The bar may include at least one attachment connection.

As is illustrated in FIGS. 1 through 10, a lounge chair 12 with headrest 10 may include a chair frame 24 including a head section 22 and a bottom section 52. A plurality of legs 28 may be attached to the chair frame 24. A chair covering 26 may be attached to the chair frame 24. In certain embodiments there may also be a support leg 30 that may be attached to the head section 22 of the chair frame 24. A bar 29 may be attached to the support leg 30. The bar 29 may include at least one attachment connection 32. The headrest 10 may include a headrest frame 16 that may include at least one headrest frame support 18. The at least one headrest frame support 18 may be removably attached to the at least one attachment connection 32. In certain embodiments, the at least one attachment connection 32 may be at least one slot. The headrest frame support 18 may slide into and through the slot providing a removably attached connection. A headrest cushion 14 may be connected to the headrest frame 16.

In certain embodiments the lounge chair 12 may include a plurality of armrests 54. The plurality of armrests 54 in conjunction with a plurality of extended legs 53 may allow for the headrest frame 16 to be removably connected to the head section 22 of the chair frame 24 without the need of the support leg 30. At least one attachment connection 32 may be attached to the head section 22 of the chair frame 24. The headrest frame 16 may include at least one headrest frame support 18. The at least one headrest frame support 18 may be removably attached to the at least one attachment connection 32. The headrest cushion 14 may be connected to the headrest frame 16.

Figure 4:
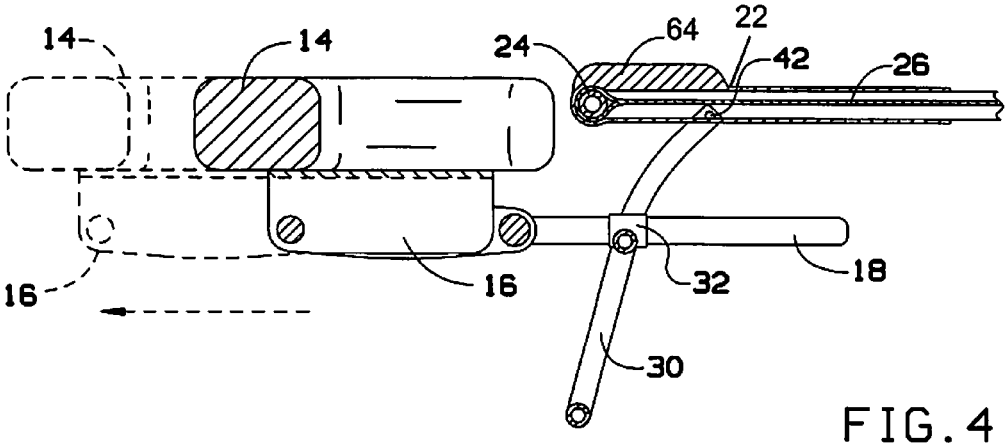
FIG. 4 is a detailed section view of an exemplary embodiment of the present invention, taken along line 4-4 in FIG. 2, illustrating the horizontal movement of the headrest.
Figure 5:
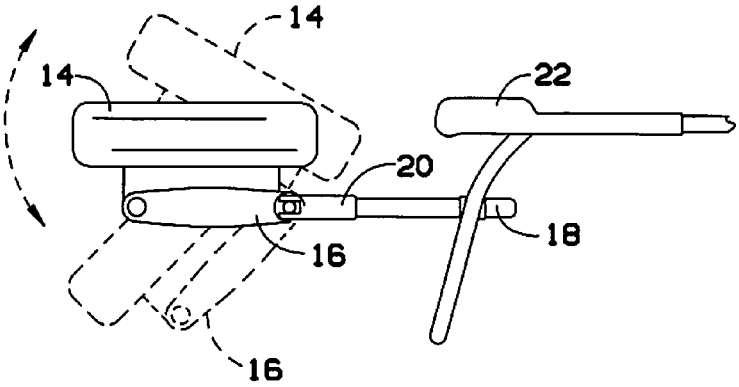
FIG. 5 is a side view of an exemplary embodiment of the present invention, Illustrating the movement of the headrest platform and pad.
Figure 6:
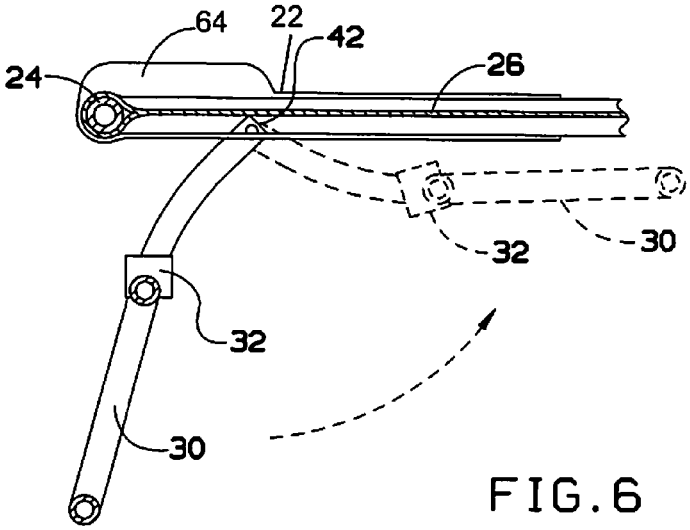
FIG. 6 is a detail section view of an exemplary embodiment of the present invention with a headrest removed, illustrating the folding of the leg.
Figure 7:
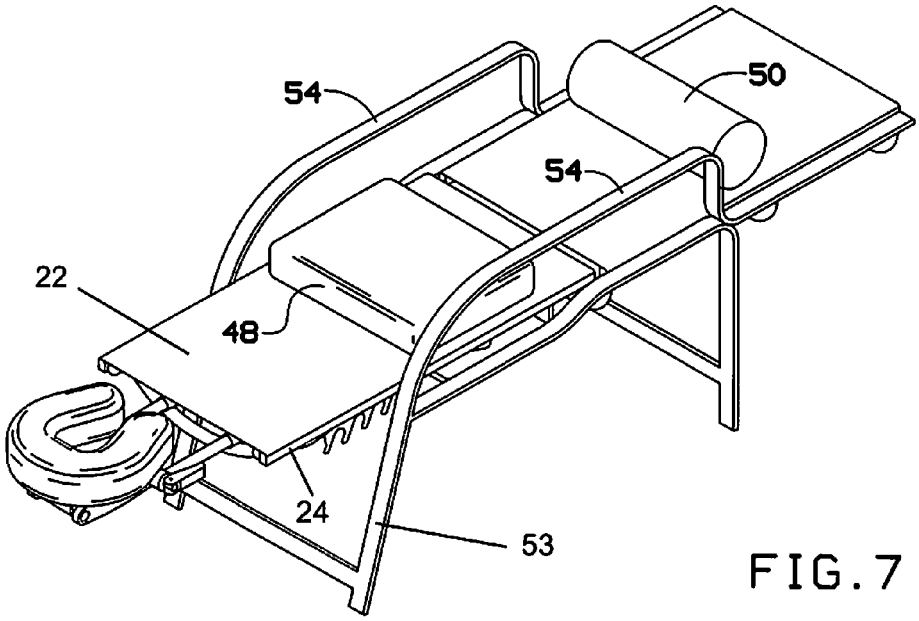
FIG. 7 is a perspective view of an alternate embodiment of the present invention with optional pads.
Figure 8:
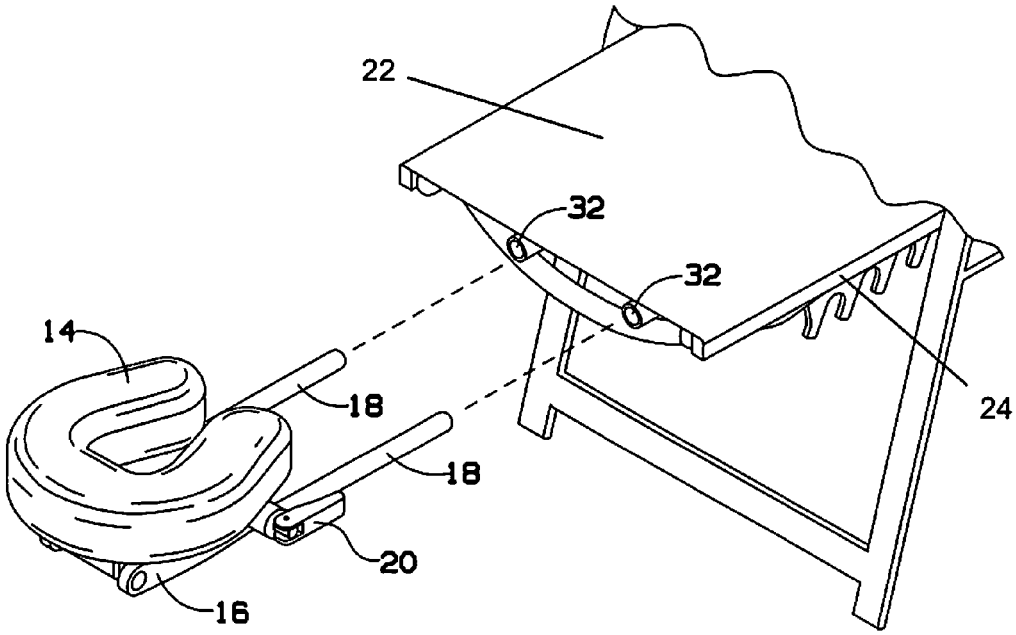
FIG. 8 is a detail exploded view of an alternate embodiment of the present invention.
Figure 9:
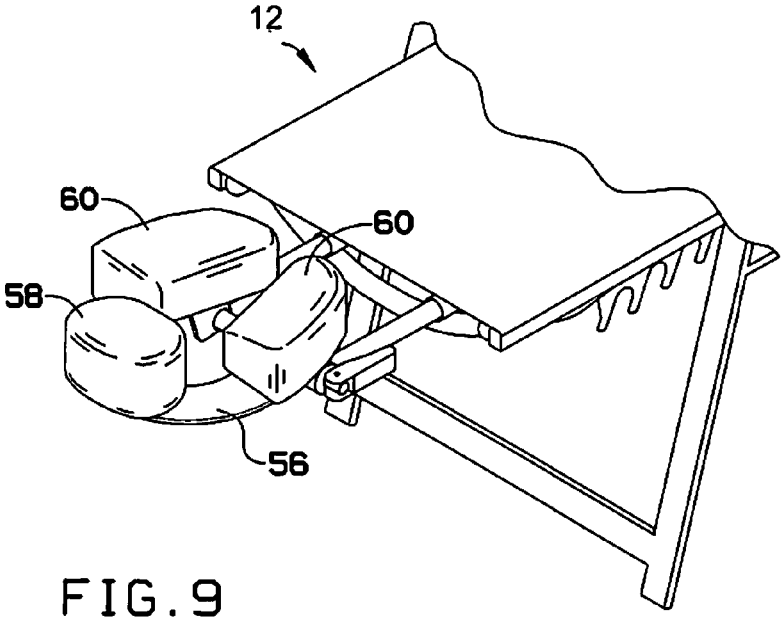
FIG. 9 is a perspective view of a headrest cushion on an alternate embodiment of the present invention.
Figure 10:
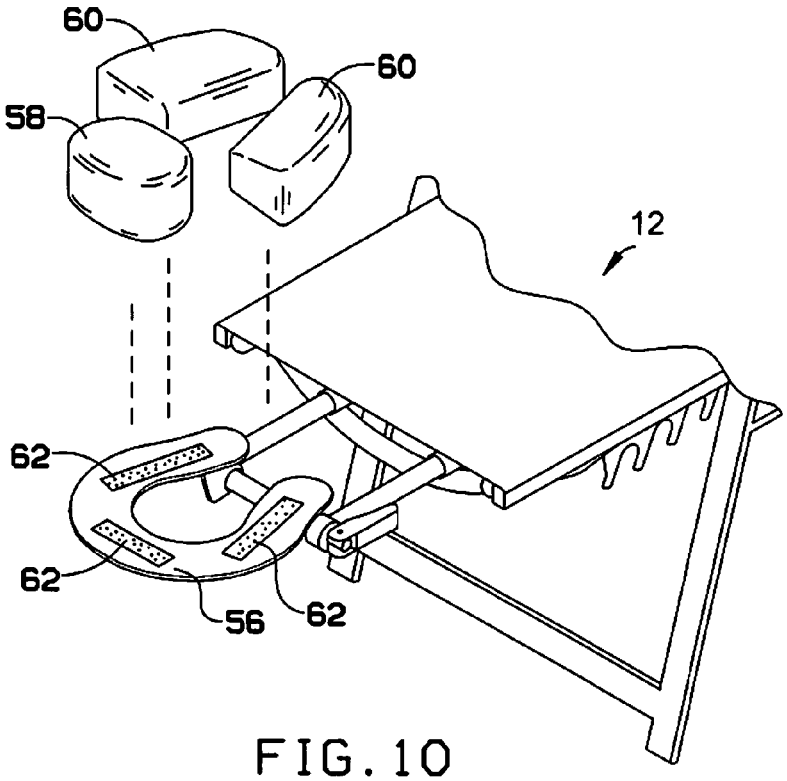
FIG. 10 is a detail exploded view of the headrest cushion on an alternate embodiment of the present invention.

In certain embodiments the distance between the headrest 10 and the lounge chair 12 may be extended or shortened by the adjustment of the at least one headrest frame support 18 as is shown in FIG. 4. In certain embodiments, the at least one headrest frame support 18 may extend through the at least one slot at different lengths so that the distance between the headrest 10 and the lounge chair 12 may be adjusted. The headrest cushion 14 and the headrest frame 16 may also vertically pivot in relation to the lounge chair 12, allowing variable positions of neck flexion and extension, as is shown in FIG. 5. The ability for the headrest frame 16 to vertically pivot may be controlled by a headrest adjustment knob 20. The headrest adjustment knob 20 may be loosened when pivoting the headrest 10, and then tightened when a position is settled upon. In certain embodiments at least one pivot pin 42 and at least one pivot pin hole 40 or the like may be attached to the support leg 30 and the chair frame 24 allowing the support leg 30 to pivot under and right below the chair frame 24 as is shown in FIG. 6. In certain embodiments at least one cushion may be positioned above the chair frame 24 in order to provide comfort to a user 46 while lying on the lounge chair with headrest with the user 46 face down. The at least one cushion may include a mid-section cushion 48, a leg cushion 50 or the like. The at least one cushion may also include a top cushion 64 located along the head section 22 of the lounge chair with headrest.

In certain embodiments, the headrest cushion 14 may be separated into an upper section 58 and two lower sections 60. The upper section 58 and the two lower sections 60 may be attached with a hook and loop fastener 62 or the like to the headrest frame 16, an alternate headrest frame 56 or the like. When the headrest cushion 14 may be separated, a user may lay face down on the upper section 58 and the two lower sections 60 while wearing glasses, other eyewear and the like, without having to reposition. The separated sections may be adjusted by the user to allow for light to enter in from the side improving vision and may allow the user to wear eye glasses, reading glasses and the like with comfort.

While lying face down on the lounge chair, an individual may put their head in the headrest and not have to turn their neck and head to breath. In certain embodiments, by providing an additional support leg towards the head of the lounge chair, the present device may support the movement of mass toward the head of the lounge chair when the headrest is used. In alternate embodiments, by extending the legs toward the head of the lounge chair, the present device may support the movement of mass toward the head of the lounge chair when the headrest is used. The position of the headrest allows a user, while lying face down, to adjust the headrest to their comfort. In another position, the user may lay face up and put their head in the headrest and adjust the headrest to their comfort. At least one cushion may be added to the lounge chair in order to provide additional support. The mid-section cushion may be used around the stomach area for a user face down, and for the small of the user's back when lying face up. The leg cushion may be used around the ankle area when facing down and for under the knees of the user when they are facing up.

Although the present invention is illustrated with an exemplary lounge chair and an alternate exemplary lounge chair, it should be noted that the support leg, attachment connection and headrest frame support may be adapted to fit varying styles of chairs in varying configurations.

It should be understood, of course, that the foregoing relates to exemplary embodiments of the invention and that modifications may be made without departing from the spirit and scope of the invention as set forth in the following claims.

What is claimed is:

1. A lounge chair comprising:

a chair frame including:

a first seat section extending between a first section first end and a first section second end;

a second seat section extending between a second section first end and a second section second end, the second section first end being pivotably connected to the first section second end such that the first and second seat sections are movable into a coplanar configuration; and a plurality of legs supporting the chair frame to elevate the first and second seat sections above an underlying surface; and a headrest including:

a headrest frame support;

a headrest frame carried by the headrest frame support; and a plurality of headrest cushion sections releasably secured to the headrest frame; and wherein the plurality of legs include a first leg connected proximate to the first section first end, and a second leg connected proximate to the second section second end; and wherein the headrest frame support is connected to a crossbar of the first leg at a level below the first seat section and extends substantially parallel to the first seat section when the first seat section is in the coplanar configuration with the second seat section.

2. The lounge chair of claim 1, wherein the chair frame further includes a third seat section extending between a third section first end and a third section second end, the third section first end being pivotably connected to the second section second end such that the first, second and third seat sections are all movable into the coplanar configuration.

3. The lounge chair of claim 2, wherein a third leg is connected proximate to the second section second end.

4. The lounge chair of claim 3, wherein the first, second and third legs are all foldable relative to the seat sections.

5. The lounge chair of claim 1, wherein the chair frame further includes a pair of armrests.

6. The lounge chair of claim 5, wherein the pair of arm rests are connected to the plurality of legs.

7. The lounge chair of claim 1, wherein the headrest frame defines a central opening such that a user lying in a prone position with the first and second seat sections in the coplanar configuration can face downwardly through the central opening.

8. The lounge chair of claim 7, wherein the plurality of cushion sections include an upper cushion section arranged on an edge of the central opening most remote from the first section first end and a first lower cushion section extending adjacent the central opening toward the first section first end.

9. The lounge chair of claim 8, wherein the plurality of cushions further include a second lower cushion section extending adjacent the central opening toward the first second first end opposite the first lower cushion section.

10. The lounge chair of claim 7, wherein the headrest frame is C-shaped, the central opening being defined in the center of the C-shaped headrest frame, and the open end of the C-shaped headrest frame being proximate to the first section first end.

11. The lounge chair of claim 1, wherein the headrest frame support is slidably connected to the chair frame, such that a distance between the headrest frame and the first section first end is adjustable.

12. The lounge chair of claim 11, wherein the headrest frame is pivotably connected to the headrest frame support, such that the headrest frame is pivotable into and out of a plane of the first and second seat sections in the coplanar configuration.

13. The lounge chair of claim 12, wherein the headrest frame is pivotable above and below the plane of the first and second seat sections in the coplanar configuration.

14. A method for using the lounge chair of claim 1 to reduce cervical spine strain for a prone lounge chair user, the method comprising:

arranging the prone lounge chair user on the lounge chair such that a head of the prone lounge chair user is supported by the plurality of headrest cushion sections with the head facing through a central opening defined by the headrest frame.

* * * * *